US006355393B1

(12) United States Patent
Hirai et al.

(10) Patent No.: US 6,355,393 B1
(45) Date of Patent: Mar. 12, 2002

(54) IMAGE-FORMING METHOD AND ORGANIC LIGHT-EMITTING ELEMENT FOR A LIGHT SOURCE FOR EXPOSURE USED THEREIN

(75) Inventors: Hiroyuki Hirai; Yasushi Araki, both of Minami-ashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/521,918

(22) Filed: Mar. 9, 2000

(30) Foreign Application Priority Data

Jul. 14, 1999 (JP) ..... 11-200231

(51) Int. Cl.[7] ..... G03C 5/10; G03C 7/00; G03C 7/30

(52) U.S. Cl. ..... 430/139; 430/236; 430/220; 430/363; 355/32; 355/37; 355/70

(58) Field of Search ..... 430/139, 363, 430/236, 220; 355/32, 37, 70

(56) References Cited

U.S. PATENT DOCUMENTS 3,591,283 A * 7/1971 Peisach ..... 430/139
3,600,172 A * 8/1971 Land ..... 430/139
4,770,978 A * 9/1988 Matsuzaka et al. ..... 430/363
4,820,606 A * 4/1989 Miyasaka et al. ..... 430/139
4,963,476 A * 10/1990 Sugimoto et al. ..... 430/363
5,415,978 A * 5/1995 Asami et al. ..... 430/363
5,607,812 A * 3/1997 Naito et al. ..... 430/220
5,744,287 A * 4/1998 Roberts et al. ..... 430/363
5,949,528 A * 9/1999 Iwasaki ..... 355/37

FOREIGN PATENT DOCUMENTS

JP 7-22649 1/1995

* cited by examiner

*Primary Examiner*—Richard L. Schilling
(74) *Attorney, Agent, or Firm*—Sughrue Mion, PLLC

(57) ABSTRACT

There is disclosed an image-forming method, which comprises: subjecting a color light-sensitive material to exposure, by using, at least, a first, second, and third light-emitting element whose peak wavelength of the light-emission spectrum is in a first wavelength region of 380 to 500 nm, a second wavelength region of 500 to 600 nm, and a third wavelength region of 600 to 740 nm, respectively, and subjecting the exposed color light-sensitive material to development processing, wherein the color light-sensitive material has, at least, spectral sensitivities in the from first to third wavelength regions. There is also disclosed organic light-emitting elements for use as light sources for exposure in the method. According to the method, digital color images exhibiting good color reproduction can be obtained by exposing a light-sensitive material according to image information and carrying out development processing.

8 Claims, No Drawings

IMAGE-FORMING METHOD AND ORGANIC LIGHT-EMITTING ELEMENT FOR A LIGHT SOURCE FOR EXPOSURE USED THEREIN

FIELD OF THE INVENTION

The present invention relates to an image-forming method using a light-emitting element as a light source for exposure. More specifically, the present invention relates to a color image-forming method, in which images are obtained by digital exposure in accordance with image information using an organic light-emitting element, and carrying out development processing.

Further, the present invention relates to an organic light-emitting element for a light source for exposure. More specifically, the present invention relates to an organic light-emitting element for a light source for exposure for subjecting to digital exposure a silver halide light-sensitive material in accordance with image information.

Further, the present invention relates to an organic light-emitting element for use as a light source for exposure, which element is used in the color image-forming method.

BACKGROUND OF THE INVENTION

Heretofore, laser diodes (LD) and inorganic light-emitting emitting diodes (LED), known as light-emitting elements, have been utilized as light sources for exposure for writing on light-sensitive materials. However, the wavelengths of light to be emitted from LD or LED cannot be easily changed, and little latitude of choice of wavelength is left for blue-light-emitting elements in particular.

An organic light-emitting element is a self-light-emitting-type element that emits light according to the following mechanism. An organic compound layer, having a thickness of 1 $\mu$m or less, is held by being pinched between two electrodes, and a voltage is applied between the two electrodes. As a result, electrons are injected from one electrode (cathode), and holes are injected from another electrode (anode). Since the electrons and the holes are recombined in the organic compound layer, to excite the neighboring light-emitting material, light is emitted. In recent years, active research and development on organic light-emitting elements have been conducted.

Utilizing the advantage of being thin planar light-emitting elements, besides displays, conceivable uses of the organic light-emitting element include as a back light for an LCD, as a light source for illumination, as a light source for optical communication, as reading/writing heads for information files, and the like. The application of the organic light-emitting element to a light source for writing on a light-sensitive material is described in JP-A-7-22649 ("JP-A" means unexamined published Japanese patent application). In this official gazette, it has been proposed to expose generally commercialized photographic films, or films for instant cameras, by using an optical recording apparatus that has an optical writing unit, in a state of a dot array made up of organic light-emitting elements in a plurality of lines according to respective colors to be emitted. However, the light-emission spectra of elements are not specifically described in the official gazette. In a light-sensitive material, such as a silver halide color light-sensitive material having at least three spectral sensitivities in the visible light region, e.g., the three regions of red (R), green (G), and blue (B), the light-emission spectrum of a light source for exposure, particularly the light-emission spectrum of the light source in the central region (usually green (G)), is very important. This is because exposure using an ordinary organic light-emitting element having a broad half width leads to the problem that images having poor color reproduction are formed, due to the occurrence of color impurity (in the case of a negative light-sensitive material) and/or disappearing (or washing out) of color (in the case of a positive light-sensitive sensitive material). This phenomenon is likely to occur particularly in the exposed portion of the central region (generally green [G]); and particularly, if an ordinary green (G)-emitting organic light-emitting element, which has a broad half width, is used, part of the red (R) or blue (B) region is also exposed, and color impurity or disappearing of color as mentioned above is likely caused.

SUMMARY OF THE INVENTION

An object of the present invention is to solve the above-described problem. That is, an object of the present invention is to obtain color images exhibiting good color reproduction by exposing a light-sensitive material according to image information using a light-emitting element, in particular an organic light-emitting element, and carrying out development processing.

Another object of the present invention is to provide an organic light-emitting element for a light source for exposure in a green (G) region, with the said element exhibiting faithful color reproduction without causing color impurity or disappearing of color in the image to be obtained, when recording based on color image information is carried out in a light-sensitive material having at least three spectral sensitivities in the visible region.

Other and further objects, features, and advantages of the invention will appear more fully from the following description.

DETAILED DESCRIPTION OF THE INVENTION

The objects of the present invention have been attained by the following means.

(1) An image-forming method, which comprises:

subjecting a color light-sensitive material to exposure, by using, at least, a first light-emitting element whose peak wavelength of the light-emission spectrum is in a first wavelength region of 380 to 500 nm, a second light-emitting element whose peak wavelength of the light-emission spectrum is in a second wavelength region of 500 to 600 nm, and a third light-emitting element whose peak wavelength of the light-emission spectrum is in a third wavelength region of 600 to 740 nm, and subjecting the exposed color light-sensitive material to development processing, wherein the color light-sensitive material has, at least, spectral sensitivities in the from first to third wavelength regions.

(2) The image-forming method as described in (1), wherein the peak wavelengths of the light-emission spectra of the first to third light-emitting elements are apart at least 50 nm from each other.

(3) The image-forming method as described in (1) or (2), wherein the half width of the light-emission spectrum of the second light-emitting element is 80 nm or less.

(4) The image-forming method as described in (3), wherein the half width of the light-emission spectrum of the second light-emitting element is 60 nm or less.

(5) The image-forming method as described in any one of (1) to (4), wherein the color light-sensitive material is a silver halide color light-sensitive material.

(6) The image-forming method as described in (5), wherein the silver halide color light-sensitive material is a diffusion transfer-type color light-sensitive material comprising:

a light-sensitive sheet, which comprises an image-receiving layer, a white reflecting layer, a light-shielding layer, and three light-sensitive silver halide emulsion layers that each are combined with a dye image-forming compound and each have a spectral sensitivity, at least, in the from first to third wavelength regions, provided on a transparent support, a transparent cover sheet, which has at least a neutralizing layer and a neutralization-timing layer, provided on a transparent support, and a light-shielding alkaline composition positioned in a developable way between the light-sensitive sheet and the transparent cover sheet.

(7) The image-forming method as described in any one of (1) to (6), wherein the exposure time per pixel is 1 to $10^{-7}$ second.

(8) An organic light-emitting element for a light source for exposure, which has a transparent electrode and a back-side electrode on a substrate, and has at least one organic compound layer including a light-emitting layer, between the two electrodes, wherein the peak wavelength of the light-emission spectrum of the organic light-emitting element is 500 to 600 nm, and the half width of the light-emission spectrum of the organic light-emitting element is 80 nm or less.

(9) The organic light-emitting element for a light source for exposure as described in the above (8), wherein the half width of the light-emission spectrum is 60 nm or less.

(10) An organic light-emitting element for a light source for exposure, which has a multilayer film mirror, a transparent electrode, at least one organic compound layer including a light-emitting layer, and a back-side electrode, in that order, on a transparent substrate, wherein a minute optical resonator is formed between the multilayer film mirror and the back-side electrode.

(11) The organic light-emitting element for a light source for exposure as described in the above (10), wherein the light-emission intensity at $\theta=30°$ is not more than 0.7 times the light-emission intensity at $\theta=0°$, where $\theta$ is an angle between the light incident on the interface of the organic compound layer and the transparent electrode, and a line perpendicular to the interface.

The present invention is described in further detail.

The image-forming method of the present invention is characterized in that at least three kinds of light-emitting elements are used as the light source for exposure of a light-sensitive material. The peak wavelengths of the light-emission spectra of the three kinds of light-emitting elements lie in the range of 380 to 500 nm (hereinafter referred to as "the first wavelength region"), 500 to 600 nm (hereinafter referred to as "the second wavelength region"), and 600 to 740 nm (hereinafter referred to as "the third wavelength region"), respectively. Preferably, the peak wavelengths of the three kinds of light-emitting elements are 400 to 490 nm, 510 to 590 nm, and 610 to 720 nm, respectively. From the standpoint of color separation, preferably, in the three kinds of light-emitting elements, the peak wavelengths of the light-emission spectra are apart at least 50 nm from each other. The half width of the light-emission spectrum is particularly important in the light-emitting element having a light-emission peak in the second wavelength region, which is the central region. The half width of the light-emission spectrum of this light-emitting element is preferably 80 nm or less, and more preferably 60 nm or less.

Meanwhile, in the light-emitting elements having peak wavelengths in the first and third wavelength regions, the preferred range of the half width is so broad that, if the peak wavelength is, for example, 410 nm, even an element whose half width is 150 nm can be used, and, if the peak wavelength is, for example, 680 nm, even an element whose half width is 150 nm can be used.

After investigating the relationship between various light-sensitive materials described later and light-emission spectra of organic-light emitting elements when light-sensitive materials having at least three spectral sensitivities in the visible light region are given exposure to light by using organic-light emitting elements, we found that the preferable green (G) light-emitting element, which does not cause color impurity or disappearing of color in the red (R) and blue (B) regions, exhibits a light-emission spectrum in which the peak wavelength is 500 to 600 nm and the half width is 80 nm or less.

Further, preferably the peak wavelength is 510 to 590 nm, and the half width is 60 nm or less, in the light-emission spectrum of the green (G) light-emitting element.

What is described above is clearly different from that, in the case of a red (R) or blue (B) light-emitting element, the shift of the peak wavelength of light emission toward the longer-wavelength side (for an R light-emitting element), or toward the shorter-wavelength side (for a B light-emitting element), causes good color reproduction even if the peak of light emission does not coincide with the peak of the spectral sensitivity of the light-sensitive material.

The light-emitting element for use in the image-forming method of the present invention is preferably an organic light-emitting element.

The organic light-emitting element of the present invention may be constructed such that it comprises a transparent electrode (generally acting as an anode) of tin oxide, indium tin oxide (ITO), indium zinc oxide, or the like, formed on a transparent substrate; at least one organic compound layer (the film thickness of the total organic compound layer is preferably 10 nm to 1 $\mu$m) including a light-emitting layer formed thereon, and a back-side electrode (generally acting as a cathode) of magnesium-silver, aluminum, lithium-aluminum, calcium, or the like, formed further on that layer. Alternatively, the organic light-emitting element may be constructed such that it comprises the above-mentioned cathode formed on a substrate (the substrate does not need to be transparent in this case), at least one organic compound layer that includes a light-emitting layer formed thereon, and the above-mentioned transparent electrode further formed on that layer.

In the latter case, as the substrate, a composite material, which contains glass fibers or ceramics and is used in ordinary substrates for electric circuits, may be used. The work function of the transparent electrode (anode) is preferably 4.3 ev or more, and more preferably 4.5 eV or more. As such materials, thin films of metals, such as gold, platinum, and the like, having a large work function, may be used, besides such compounds as tin oxide.indium oxide (ITO), zinc oxide.indium oxide, tin oxide, and the like, which are known as transparent electrodes. Organic compounds, such as polyaniline, polythiophene, polypyrrole, and derivatives thereof, may also be used. Transparent electrodes of transparent conductive films are described in detail in "New Developments of Transparent Conductive Films," Supervisory Ed., Y. Sawada, CMC (1999), and these electrodes can be used in the present invention. A preferred transparent electrode has a light transmittance of at least 50%, more preferably at least 70%, in the visible light wavelength region of 400 to 700 nm.

Materials that are preferable for use in the cathode are alkaline metals, such as Li, K, and the like; alkaline earth metals, such as Mg, Ca, and the like, and alloys.mixtures of these metals with Ag, Al, or the like, each having a low work function. In order to obtain both storage stability and electron-injectability of the cathode, the cathode may be coated with Ag, Al, Au, or the like, having a high work function and high electroconductivity. The inorganic layer, such as the transparent electrode, the back-side electrode, and the like, can be formed by a known method, such as a vacuum deposition method, a sputtering method, an ion-plating method, or the like.

The patterning of electrodes (the transparent electrode in particular) can be carried out by chemical etching, such as photolithography, or by physical etching using a laser or the like. Alternatively, vacuum deposition or sputtering may be carried out on a stack of layers of masks.

In the organic light-emitting element, it is enough to provide at least one organic compound layer that includes a light-emitting layer, on the anode or cathode, and another layer(s) may also be formed, if desired. Specific examples of constructions of the organic light-emitting element containing the organic compound layer include anode/hole-transporting layer/light-emitting layer/cathode, anode/light-emitting layer/electron-transporting layer/cathode, anode/hole-transporting layer/light-emitting layer/electron-transporting layer/cathode, anode/light-emitting layer/cathode, and the like (reverse constructions are also possible). It is also possible to form a plurality of light-emitting layers, hole-transporting layers, or electron-transporting layers, or to form a hole-injecting layer or an electron-injecting layer.

In addition to the above-described constructions, in the organic light-emitting element for use in the present invention, preferably an electroconductive polymer layer adjacent to the anode is formed between the anode and the hole-transporting layer (the light-emitting layer if the hole-transporting layer is not formed). The formation of this layer makes it possible to increase the film thickness of the organic compound layer with almost no rise in the driving voltage, and to lessen the problem of unevenness in brightness and short-circuiting.

As the electroconductive polymer to form the electroconductive polymer layer, polyaniline derivatives, polythiophene derivatives, and polypyrrole derivatives, described in WO-98/05187, and the like are preferable. These derivatives can be used in a state of mixtures with protonic acids (e.g. camphorsulfonic acid, p-toluenesulfonic acid, styrenesulfonic acid, polystyrenesulfonic acid, and the like). Further, the polyaniline derivatives may be used singly or in combination of two or more of a leuco-emeraldin type, an emeraldin type, or a pernigraniline type.

If necessary, these derivatives may be used as a mixture with another polymer(s) (e.g. polymethyl methacrylate (PMMA), poly-N-vinylcarbazole (PVCz), and the like). Preferably the surface resistance of the electroconductive polymer layer is 10,000Ω/□ or less. Preferably the film thickness of the electroconductive polymer layer is 10 to 1,000 nm, and more preferably 20 to 200 nm.

The light-emitting layer that can be used in the organic light-emitting element for use in the present invention may be an electron-transportable light-emitting layer or a hole-transportable light-emitting layer. The light-emitting layer contains at least one kind of an organic light-emitting material. The light-emitting material is not particularly limited, and a material capable of emitting fluorescent light when excited can be the light-emitting material. Examples of the light-emitting material to be used in the invention include oxinoid compounds, perylene compounds, coumarin compounds, azacoumarin compounds, oxazole compounds, oxadiazole compounds, perinone compounds, pyrrolopyrrole compounds, naphthalene compounds, anthracene compounds, fluorene compounds, fluoranthene compounds, tetracene compounds, pyrene compounds, coronene compounds, quinolone compounds and azaquinolone compounds, pyrazoline derivatives and pyrazolone derivatives, Rhodamine compounds, chrysene compounds, phenanthrene compounds, cyclopentadiene compounds, stilbene compounds, diphenylquinone compounds, styryl compounds, distyrylbenzene compounds, butadiene compounds, dicyanomethylenepyran compounds, dicyanomethylenethiopyran compounds, fluorescein compounds, pyrylium compounds, thiapyrylium compounds, selenapyrylium compounds, tellulopyrylium compounds, aromatic aldadiene compounds, oligophenylene compounds, xanthene compounds and thioxanthene compounds, cyanine compounds, acridine compounds, acridone compounds, quinoline compounds, metal complexes of 8-hydroxyquinoline compounds, benzoquinol/beryllium complexes, metal complexes of 2,2'-bipyridine compounds, complexes of Schiff base with metals of the group III, metal complexes of oxadiazole compounds, complexes of rare earth elements, and the like.

These light-emitting materials may be used singly or in combination. Alternatively, they may be used by being dispersed as a molecular dispersion in a carrier-transportable polymer, or by being dispersed as a molecular dispersion together with a carrier-transporting agent having a low molecular weight in a polymer having no carrier-transportability.

The electron-transportable polymer means a polymer having an electron-acceptive group in the side chain or main chain, the hole-transportable polymer means a polymer having an electron-donative group in the side chain or main chain, and the polymer having no carrier-transportability means an electrically inert polymer, such as polymethyl methacrylate, polymethyl acrylate, polystyrene, polycarbonate, and the like. The carrier-transporting agent having a low molecular weight to be dispersed in a polymer having no carrier-transportability means an electron-transportable (electron-acceptive) or hole-transportable (electron-donative) material having a low molecular weight.

Further, it is also preferable to use a polymeric light-emitting material as the light-emitting material. Examples of the polymeric light-emitting material include, besides polymers of a π-conjugated system, such as a poly-p-phenylenevinylene derivative, a polyfluorene derivative, a polythiophene derivative, and the like, polymers having a dye of a low molecular weight and tetraphenyldiamine or triphenylamine introduced into the main chain or side chain, and the like. It is also possible to use a mixture of the polymeric light-emitting material and a light-emitting material having a low molecular weight.

Examples of the electron-transportable compound include compounds such as oxadiazole derivatives, triazole derivatives, triazine derivatives, nitro-substituted fluorenone derivatives, thiopyran dioxide derivatives, diphenylquinone derivatives, perylenetetracarboxyl derivatives, anthraquinonedimethane derivatives, fluorenylidenemethane derivatives, anthrone derivatives, perinone derivatives, oxine derivatives, quinoline derivatives, and the like.

Examples of the hole-transportable compound that can be used include poly-N-vinylcarbazole or polyphenylenevinylene derivatives, polymers such as polyphenylene, polythiophene, polymethylphenylsilane, polyaniline and the like, triazole derivatives, oxadiazole derivatives, imidazole derivatives, polyarylalkane derivatives, pyrazoline derivatives and pyrazolone derivatives, phenylenediamine derivatives, arylamine derivatives, amino-substituted chalcone derivatives, oxazole derivatives, carbazole derivatives, styrylanthracene derivatives, fluorenone derivatives, hydrazone derivatives, stilbene derivatives, porphyrin derivatives such as phthalocyanine, aromatic tertiary amine compounds and styrylamine compounds, butadiene compounds, benzidine derivatives, polystyrene derivatives, triphenylmethane derivatives, tetraphenylbenzene derivatives, starburst polyamine derivatives, and the like.

The organic compound layers, such as a hole-transporting layer, an electron-transporting layer, a light-emitting layer, an electroconductive polymer layer, and the like, can be formed by a known method, such as a vacuum deposition method, a sputtering method, a dipping method, a spin-coating method, a casting method, a bar-coating method, a roll-coating method, or the like. Further, multilayer coating is also possible by selective use of solvents.

On this electron-transporting layer, a metal electrode, such as the one described above, is formed as a cathode. It is also possible to form a layer, which is a thin layer having a thickness of approximately 0.01 to 10 nm and composed of aluminum oxide, lithium fluoride, or the like, on the electron-transporting layer, and to form the cathode on that layer. On the front face (which is the face on the side opposite to the organic compound layer) of the cathode, a protective layer for shutting out moisture or air may be formed.

In the organic light-emitting element of the present invention, the permeation of atmospheric moisture and oxygen to the organic light-emitting element can be inhibited by forming a protective layer, so that at least the organic compound layer and the back-side electrode are coated, or by enclosing the entire organic light-emitting element in a package, and the durability of the organic light-emitting element can be further improved. Protective layers for this purpose are described in official gazettes, such as JP-A-7-85974, JP-A-7-192866, JP-A-8-22891, JP-A-10-275682, JP-A-10-106746, and the like. Further, sealing of the organic light-emitting element using glass or a poly (chlorotrifluoroethylene) sheet is preferable. The insertion therein of a desiccating agent, such as BaO, a water-repellent fluorine-series inert liquid.inert gas, or the like, as described in JP-A-9-148066, may also be done. An epoxy resin having low moisture permeability and strong adhering strength and thermal stability is preferable as the sealing agent.

As to the transparent substrate of the organic light-emitting element for use in the present invention, a plastic substrate can be used besides an ordinary glass substrate. Preferably the plastic substrate is composed of a material having excellent heat resistance, dimensional stability, solvent resistance, electrical insulation, processability, low gas permeability, and low moisture absorption. Examples of such material include polyethylene terephthalate, polybutylene terephthalate, polyethylene naphthalate, polystyrene, polycarbonate, polyethersulfone, polyarylate, allyldiglycol carbonate, polyimide, and the like. Preferably a moisture permeation-preventing layer (gas barrier layer) is formed on the substrate front face, or on its face opposite to the side having the electrode (this face is hereinafter referred to as the "back face"). The material of the moisture permeation-preventing layer (gas barrier layer) is preferably an inorganic substance, such as silicon nitride, silicon oxide, or the like, and the film can be formed by, for example, a high-frequency sputtering method. Furthermore, a hardcoat layer or undercoat layer may be formed, if necessary.

Patterning may be made on the electrode layer (transparent electrode layer in particular). As for the patterning method, it may be carried out by chemical etching, such as photolithography or the like, or by physical etching using a laser or the like. It is also possible to carry out vacuum deposition, sputtering, or the like on masks that are stacked in layers.

In the present invention, besides the organic light-emitting elements constructed as described above, an organic light-emitting element having a minute optical resonator structure (microcavity) is particularly preferable, from the standpoint of the small half width of the light-emission spectrum and excellence in directivity. This organic light-emitting element has a multilayer film mirror having two kinds of layers, whose refractive indices are different, laminated alternately; a transparent electrode (generally acting as an anode), at least one layer of an organic compound layer including a light-emitting layer, and a back-side electrode acting as a metal mirror (generally acting as a cathode), formed, in that order, on a transparent substrate, wherein a minute optical resonator is formed between the multilayer film mirror and the back-side electrode. The multilayer film mirror is formed generally by combining dielectric or semiconducting substance layers whose optical lengths are each ¼ of the target wavelength of the light to be emitted. Examples of typical combinations include dielectric substances, such as $TiO_2$ and $SiO_2$, $SiN_x$ and $SiO_2$, $Ta_2O_5$ and $SiO_2$, and the like, and semiconducting substances, such as GaAs and GaInAs, and the like. The film thickness may be adjusted by inserting an $SiO_2$ spacer between the transparent electrode (ITO or the like) and the multilayer film mirror. Further, the uppermost layer of the multilayer film mirror may be formed of a transparent electroconductive layer, and the layer can be used both by the multilayer film mirror and by the transparent electrode. This case is preferable, because the thickness of the transparent electrode (transparent electroconductive layer) can be relatively large and the surface resistance of the electrode can be reduced, so that the heat generation of the element is inhibited.

In the present invention, in order to minimize the infiltration of light into neighboring pixels, preferably the directivity of the light to be emitted is as high as possible. For that purpose, the light-emission intensity at $\theta=30°$ is preferably not more than 0.7 times the light-emission intensity at $\theta=0°$, where $\theta$ is the angle between the light incident on the interface of the organic compound layer and the transparent electrode, and a line perpendicular to the interface, and more preferably not more than 0.5 times. The directivity can be adjusted by properly setting the wavelength of the light to be emitted or the optical length of the resonator.

The organic light-emitting element having a minute optical resonator structure (microcavity) is described in, for example, "Organic EL Displays", p.105, extra number to "Monthly Display" (Gekkan Display), October, 1998, issued from Technotimes Co., Ltd., JP-A-9-180883, and others.

Further, an end-face light-emitting type element utilizing a waveguide mode (e.g., "Nature", vol. 389 (1997), p.362, and ibid., vol. 389 (1997), p.466) can also be used in the present invention.

In the present invention, the organic light-emitting element can be used in a single pixel, and preferably the element is used as a dot array in which a plurality of the elements are provided in lines according to respective colors of lights to be emitted. Each color of light to be emitted may be in one line or in a plurality of lines. The size of one pixel is generally 10 to 500 $\mu$m, and preferably of 50 to 300 $\mu$m. In the case where a plurality of lines are formed, the region between lines is preferably comprised of a non-light-emitting region of 1 μm to 1 mm, and more preferably 5 μm to 300 μm. Preferably, in the region between lines, the surface of the element is smoothened by using an electrically insulating light-shielding material, because stray light is inhibited.

The organic light-emitting element having the above-described construction is caused to emit light by driving the lines successively in a manner of line after line. The light-emitting time for one light emission is generally 100 milliseconds to 10 nanoseconds, and preferably 10 milliseconds to 1 microsecond.

Light can be emitted from the above-described organic light-emitting elements by applying a direct current voltage (generally a pulse voltage in the range of 2 to 30 V, which may contain an alternating current component, if necessary) or a pulse current between the anode and the cathode. In the image-forming method of the present invention, when the time for writing one image plane is taken into consideration, the exposure time per pixel is preferably 1 to $10^{-7}$ second, and more preferably $10^{-1}$ to $10^{-6}$ second. As to the driving of the organic light-emitting elements that can be used in the present invention, the methods described in JP-A-2-148687, JP-A-6-301355, JP-A-5-29080, JP-A-7-134558, JP-A-8-234685, JP-A-8-241047, and the like can also be utilized.

In the present invention, control of the amount of exposure of the organic light-emitting element may be made by an intensity modulation system or a time modulation system. According to the intensity modulation system, the electric current to be flowed through the element is controlled, to control the light-emission intensity of the element, to control the amount of exposure. According to the time modulation system, control of the amount of exposure is achieved by causing the element to shine at a constant intensity and changing the illumination time. In addition, it is also possible to adopt a system in which the light is generated in pulses, and the amount of exposure is controlled by the count of the illuminating pulses, that is a so-called pulse modulation system.

The peak wavelengths of the light-emission spectra of red (R) and blue (B) organic light-emitting elements to be used together with the organic light-emitting element (green (G)) of the present invention are preferably 600 to 740 nm and 380 to 500 nm, respectively.

Further, the organic light-emitting elements for red (R) and blue (B) may be the previously described organic light-emitting elements having a minute optical resonator structure, or end-face light-emitting-type elements utilizing a waveguide mode. By the use of these elements, a light source for exposure having quite high directivity can be obtained, and the sharpness and color reproduction of the images to be obtained can be further improved.

In the image-forming method of the present invention, a color light-sensitive material having, at least, spectral sensitivities in the from first to third wavelength regions, is used. Examples of the light-sensitive material include, besides a silver halide color light-sensitive material, a silver trigger-type color light-sensitive material (described in, for example, "Known Technologies (Kochi-Gijutsu)", No. 5 [issued on Mar. 22, 1991, ASTECH Inc.]), and a non-silver light-sensitive material (a material such as Cycolor (trade name), which forms images by dry processing using heat, pressure, or the like, is particularly preferable for use in the image-forming method of the present invention). In order to obtain a wide range of colors in the chromaticity diagram by using three primary colors of yellow, magenta, and cyan, the light-sensitive material is constructed such that it has spectral sensitivities in the first, second, and third wavelength regions, respectively, by using yellow, magenta, and cyan colorants.

The silver halide light-sensitive materials that can be used are not limited to such color light-sensitive materials as usual photographic (for shooting) color negative films, color reversal films, materials for color prints, instant films, heat-development-type color light-sensitive materials, and the like, and almost all light-sensitive materials, such as black-and-white photographic negative films, materials for prints, and heat-development-type light-sensitive materials, and the like, can be used.

The smaller the energy required to make the light-sensitive sensitive material for use in the present invention sensitized, the more preferable the light-sensitive material is. This is because the power of the light source for exposure can be made smaller, and therefore the life of the light-emitting element for use in the exposure can be prolonged. Accordingly, combining with a silver halide color light-sensitive material having a high sensitivity is particularly preferable in the present invention. The silver halide color light-sensitive material may be of a negative type or a positive type.

After being exposed by the light-sensitive elements, the light-sensitive material is subjected to development processing.

When a silver halide color light-sensitive material is used as the light-sensitive material, the development processing of the silver halide color light-sensitive material may be performed by a usual wet process, in which the light-sensitive material is subjected to development by being immersed in a color-developing solution containing a developing agent and kept at 30 to 40° C., and the method undergoes a desilverization treatment and rinsing with water. Further, a heat-development processing, in which a color image is obtained on a light-sensitive material or an image-receiving material by using and heating the light-sensitive material and/or image-receiving receiving material containing a base precursor, is preferable from the standpoint of short-time processing. Furthermore, particularly preferably the light-sensitive material is a silver halide color light-sensitive material that comprises a light-sensitive sheet comprising an image-receiving layer, a white reflecting layer, a light-shielding layer, and at least one light-sensitive silver halide emulsion layer that is combined with a dye image-forming compound, provided on a transparent support; a transparent cover sheet, which has at least a neutralizing layer and a neutralization timing layer, provided on a transparent support, and a light-shielding alkaline composition positioned in a developable way between the light-sensitive sheet and the transparent cover sheet. This is because the above-described silver halide color light-sensitive material can be subjected to development by diffusion transfer and, as a result, the development processing can be performed in a rapid and compact way. For carrying out the development processing by diffusion transfer, the light-sensitive sheet and the transparent cover sheet are put together face to face, so that the alkaline processing composition is contained between the two sheets, and the alkaline processing composition is developed (applied) by using pressing rollers.

The diffusion transfer-type silver halide color light-sensitive material preferably has three light-sensitive silver halide emulsion layers; that is, a blue-sensitive layer containing a yellow colorant and a blue-sensitive silver halide emulsion, a green-sensitive layer containing a magenta colorant and a green-sensitive silver halide emulsion, and a red-sensitive layer containing a cyan colorant and a red-sensitive silver halide emulsion (combinations of colorants (dye-forming compounds), and the sensitive wavelength regions of the silver halide emulsion layers, are not limited to these combinations). The dye-forming compound does not need to be contained in the light-sensitive silver halide emulsion layer, and it may be contained in another layer adjacent to the emulsion layer in the combination. In addition, if necessary, a variety of auxiliary layers, such as a protective layer, an undercoat layer, an intermediate layer, a yellow-filter layer, an antihalation layer, a backing layer, and the like, can be provided. Such layers as a subbing layer, a protective layer, and the like can be further added to the backing layer. Further, each light-sensitive layer may be divided into two or more layers. When the support is a polyethylene-laminated paper containing a white pigment, such as titanium oxide or the like, preferably the backing layer is designed such that it has an antistatic function and a surface resistivity of $10^{12}\Omega$.cm or less.

According to the image-forming method of the present invention, a color image excellent in color reproduction can be obtained by exposing a light-sensitive material by using organic light-emitting elements in accordance with image information and carrying out development processing.

According to the present invention, it is possible to provide an organic light-emitting element for use as a green (G) region light source for exposure, with the said element exhibiting faithful color reproduction without causing color impurity or disappearing of color in the image to be obtained, when recording based on color image information is carried out in a light-sensitive material having at least three spectral sensitivities in the visible light region. In particular, according to the present invention, by use of the organic light-emitting element having a minute optical resonator structure, the half width of the light-emission spectrum becomes more smaller, the directivity becomes more larger, and the sharpness of the images to be obtained are further improved, together with the color reproduction.

The present invention will be described in more detail based on examples given below, but the present invention is not meant to be limited by these examples.

EXAMPLES

<Preparation of Three Kinds of Light-emitting Elements>

(Preparation of a Light-emitting Element G1)

An ITO (anode) film (a thickness of 200 nm) was formed on a square glass substrate having sides of 5 cm and a thickness of 0.7 mm, and the film underwent patterning by using photoresist, so that ten square pixels, each having sides of 100 $\mu$m, were arrayed linearly at intervals of 10 $\mu$m. The film was immersed in isopropyl alcohol (IPA) and subjected to ultrasonic cleaning for 15 minutes. After that, the film was treated by a UV-ozone radiator for 30 minutes. On the pixels arrayed linearly, N,N'-diphenyl-N,N'-bis(3-methylphenyl)(1,1'-biphenyl)-4,4'-diamine (TPD) was vacuum-deposited, at a thickness of 50 nm, and thereafter a quinolinol-aluminum complex (Alq) was vacuum-deposited, at a thickness of 50 nm. Subsequently, on these organic layers, Mg and Ag were vacuum-deposited, at a molar ratio of Mg:Ag of 10:1, and at a thickness of 50 nm, to form a cathode, and the cathode was protected by vacuum-depositing Ag, at a thickness of 60 nm. The glass substrate was sealed, using glass and a UV-curable resin, in an Ar globe box. The thus-prepared element was caused to emit light by applying an electric current of 100 mA/cm$^2$, and the light-emission spectrum was measured. The peak wavelength was 517 nm, and the half width was 95 nm.

(Preparation of a Light-emitting Element R1)

A light-emitting element R1 was prepared in the same manner as in the preparation of the light-emitting element G1, except that a light-emitting layer having a thickness of 90 nm was formed by spin-coating a 0.5% solution of poly(2-methoxy-5-2'-ethylhexyloxy)-1,4-phenylenevinylene (MEH-PPV) in dichloroethane, instead of the vacuum-deposition of the organic layers. The element was caused to emit light by applying an electric current of 100 mA/cm$^2$, and the light-emission spectrum was measured. The peak wavelength was 600 nm, and the half width was 120 nm.

(Preparation of a Light-emitting Element B1)

A light-emitting element B1 was prepared in the same manner as in the preparation of the light-emitting element G1, except that the organic compound layers were formed in the following way.

Copper phthalocyanine (CuPc) was vacuum-deposited, at a thickness of 37 nm, as a hole-injecting layer. On this layer, 4,4'-bis[N-(1-naphthyl)-N-phenylamino]biphenyl (NPB) was vacuum-deposited, at a thickness of 37 nm, as a hole-transporting layer, bis(2-methyl-8-quinolinate) aluminum-$\mu$-oxo-bis(2-methyl-8-quinolinate)aluminum was vacuum-deposited, at a thickness of 30 nm, as a light-emitting layer, and Alq was vacuum-deposited, at a thickness of 30 nm, as an electron-injecting layer, in that order. The element was caused to emit light by applying an electric current of 100 mA/cm$^2$, and the light-emission spectrum was measured. The peak wavelength was 490 nm, and the half width was 100 nm.

(Preparation of a Light-emitting Element G2)

A light-emitting element G2 was prepared in the same manner as in the preparation of the light-emitting element G1, except that the organic layers were formed by vacuum-depositing TPD, at a thickness of 50 nm, from the anode side, and vacuum-depositing Alq doped with 1 mol % of lublene, at a thickness of 50 nm, on that layer. The element was caused to emit light by applying an electric current of 100 mA/cm$^2$, and the light-emission spectrum was measured. The peak wavelength was 554 nm, and the half width was 63 nm.

(Preparation of a Light-emitting Element B2)

A light-emitting element B2 was prepared in the same manner as in the preparation of the light-emitting element G1, except that TPD was vacuum-deposited, at a thickness of 60 nm, 4,4'-bis(2,2-diphenylvinyl)biphenyl (DPNBi) was deposited thereon, at a thickness of 40 nm, to form a light-emitting layer, and Alq was then deposited, at a thickness of 20 nm, to form an electron-transporting layer. The element was caused to emit light by applying an electric current of 100 mA/cm$^2$, and the light-emission spectrum was measured. The peak wavelength was 460 nm, and the half width was 70 nm.

(Preparation of a Light-emitting Element R2)

A light-emitting element R2 was prepared in the same manner as in the preparation of the light-emitting element R1, except that the dichloroethane solution of MEH-PPV used for the light-emitting element R1 was replaced by a solution prepared by blending 5 mol % of 4-(dicyanomethylene)-2-methyl-6-euroridylvinylene-4H-pyran (DCJ) into the same solution. The element was caused to emit light by applying an electric current of 100 mA/cm$^2$, and the light-emission spectrum was measured. The peak wavelength was 650 nm, and the half width was 120 nm.

Example 1

"Fuji Color Paper" (trade name, manufactured by Fuji Photo Film Co., Ltd.) was exposed by using the light-emitting elements R1, G1, and B1. The paper was then subjected to treatments of color development using a CP40 developing solution under a standard condition, bleach-fixing, water-rinsing, and drying. The exposure was carried out by varying the applied time of the constant electric current pulse of 100 mA/cm$^2$ (exposure time was in the order of $10^{-2}$ second for each element), while the emulsion layer side of "Fuji Color Paper" was tightly adhered to the glass substrate of each element, such that the cyan, magenta, and yellow densities (as measured by a micro-densitometer) after development processing were 1.0. The degree of color impurity thus obtained was examined.

Example 2

Images were formed in the same manner as in Example 1, except that exposure was carried out by using the light-emitting elements R2, G2, and B2. The degree of color impurity was examined in the same manner as above.

The image qualities of both images formed in Examples 1 and 2 were good. In particular, the image formed in Example 2 was very good particularly in color reproduction, because no color impurity was observed at all.

Example 3

By using the three kinds of light-emitting elements that were used in Example 1, an instant film ("Instax," (trade name, manufactured by Fuji Photo Film Co., Ltd.), a diffusion transfer-type silver halide color light-sensitive material) was exposed and processed developedly by using pressing rollers inside a camera. As in Example 1, the time of exposure to each light source was varied (exposure time was in the order of $10^{-4}$ second for each element), and the degree of disappearing of color of the red, green, and blue images obtained was examined.

Example 4

Images were formed in the same manner as in Example 3, except that exposure was carried out by using the light-emitting elements R2, G2, and B2. The degree of disappearing of color was examined in the same manner as above.

The image qualities of both images formed in Examples 3 and 4 were good. In particular, the image formed in Example 4 was very good particularly in color reproduction, because no disappearing of color was observed at all.

Comparative Example 1

[Preparation of a Light-emitting Element A]

An ITO (anode) film (a thickness of 200 nm) was formed on a square glass substrate having sides of 5 cm and a thickness of 0.7 mm, and the film underwent patterning by using photoresist, so that ten square pixels, each having sides of 100 $\mu$m, were arrayed linearly at intervals of 10 $\mu$m. The film was immersed in isopropyl alcohol (IPA) and subjected to ultrasonic cleaning for 15 minutes. After that, the film was treated by a UV-ozone radiator for 30 minutes. On the pixels arrayed linearly, N,N'-diphenyl-N,N'-bis(3-methylphenyl)(1,1'-biphenyl)-4,4'-diamine (TPD) was vacuum-deposited, at a thickness of 40 nm, and thereafter a quinolinol-aluminum complex (Alq) was vacuum-deposited, at a thickness of 60 nm. Subsequently, on these organic compound layers, Mg and Ag were vacuum-deposited, at a molar ratio of Mg:Ag of 10:1, and at a thickness of 50 nm, to form a cathode, and the cathode was protected by vacuum-depositing Ag, at a thickness of 60 nm. The glass substrate was sealed, using glass and a UV-curable resin, in an Ar globe box. The thus-prepared light-emitting element A was caused to emit light by applying an electric current of 100 mA/cm$^2$, and the light-emission spectrum was measured. The peak wavelength was 520 nm, and the half width was 95 nm.

Comparative Example 2

[Preparation of a Light-emitting Element B]

A light-emitting element B was prepared in the same manner as in the preparation of the light-emitting element A, except that the organic compound layers were formed by vacuum-depositing 1,1-bis[(di-4-tolylamino)phenyl] cyclohexane (HTM2), at a thickness of 75 nm, from the anode side, and Alq doped with 0.15 mol % of 4-(dicyanomethylene)-2-methyl-6-(4-dimethylaminostyryl)-4H-pyran (DCM1) was vacuum-deposited thereon, at a thickness of 60 nm. The light-emitting element B was caused to emit light by applying thereto an electric current of 100 mA/cm$^2$, and the light-emission spectrum was measured. The peak wavelength was 582 nm, and the half width was 82 nm.

Example 5

[Preparation of a Light-emitting Element C]

A light-emitting element C was prepared in the same manner as in the preparation of the light-emitting element A, except that the organic compound layers were formed by vacuum-depositing TPD, at a thickness of 50 nm, from the anode side, and Alq doped with 1 mol % of rubrene was vacuum-deposited thereon, at a thickness of 50 nm. The light-emitting element C was caused to emit light by applying thereto an electric current of 100 mA/cm$^2$, and the light-emission spectrum was measured. The peak wavelength was 554 nm, and the half width was 63 nm.

Example 6

[Preparation of the Light-emitting Element D]

A semitransparent reflective film (multilayer film mirror) was formed on a glass substrate by laminating each three layers of $SiO_2$ film (having a thickness of 96 nm) and $TiO_2$ film (having a thickness of 58 nm). On the film thus formed, an $SiO_2$ film and an ITO film were formed, and patterning was carried out. After being washed with IPA and irradiated with UV-ozone, on the ITO film, a hole-transporting layer, composed of N,N'-diphenyl-N,N'-bis(1-naphthyl)(1,1'-biphenyl)-4,4'-diamine (NPD) and having a thickness of 50 nm, a light-emitting layer, composed of Alq doped with 1% of quinacridone and having a thickness of 60 nm, an Mg—Ag cathode having a thickness of 100 nm, and an Ag protective layer having a thickness of 60 nm, were vacuum-deposited, in that order. To make the sum of the optical distances, obtainable from the products of film thickness multiplied by the refractive index of each layer, ranging from the $SiO_2$ film to the light-emitting layer, coincide with 535 nm, which is the light-emission peak wavelength of the element, adjustment was made by the ITO film thickness and the $SiO_2$ spacer formed between the ITO film and the multilayer film mirror. After being sealed as in the case of the light-emitting element A, the light-emitting element D was caused to emit light, by applying thereto an electric current of 100 mA/cm$^2$, and the light-emission spectrum was measured. A peak wavelength of 535 nm and a half width of 20 nm were obtained. Meanwhile, in the light-emitting element D, the light-emission intensity at $\theta$=30° was 0.45 times the frontward ($\theta$=0°) light-emission intensity, and strong directivity in the frontward direction of the element was observed. The suitability as a light source for exposure was greatly improved compared with the comparative element, prepared without the multilayer film mirror, which had a half width of 90 nm and had no directivity.

<Evaluation of the Light-emitting Elements>

A peel-apart-type instant film (FP-100C, trade name) was exposed and processed developedly by using pressing rollers inside a camera. Exposure was carried out by varying the exposure time (i.e. by varying the image density) while the exposed side of the instant film was tightly adhered to the glass substrate of each of the light-emitting elements A to D.

After examination of the degree of disappearing of color of the green image obtained, it was found that the image exposed by the light-emitting element A for comparison became blue-green, due to the disappearance (absence) of yellow, and the image exposed by the light-emitting element B for comparison became yellow-green, due to the disappearance of cyan. To the contrary, the images exposed by each of the light-emitting elements C and D of the present invention reproduced the original green color. In addition, the light-emitting element D in particular provided enhanced image sharpness compared with the light-emitting element C.

Having described our invention as related to the present embodiments, it is our intention that the invention not be limited by any of the details of the description, unless otherwise specified, but rather be construed broadly within its spirit and scope as set out in the accompanying claims.

What we claim is:

1. An image-forming method, which comprises:

subjecting a color light-sensitive material to exposure, by using, at least, a first organic light-emitting element whose peak wavelength of the light-emission spectrum is in a first wavelength region of 380 to 500 nm, a second organic light-emitting element whose peak wavelength of the light-emission spectrum is in a second wavelength region of 500 to 600 nm, and a third organic light-emitting element whose peak wavelength of the light-emission spectrum is in a third wavelength region of 600 to 740 nm, and subjecting the exposed color light-sensitive material to development processing;

wherein the color light-sensitive material has, at least, spectral sensitivities in the from first to third wavelength regions;

wherein the organic light-emitting elements are those provided with at least one organic compound layer that includes a light-emitting layer, on an anode or cathode;

wherein an amount of the exposure is controlled by way of a time modulation system or a pulse modulation system;

wherein the peak wavelengths of the light-emission spectra among the first to third light-emitting elements are apart at least 50 nm from each other; and wherein the half width of the light-emission spectrum of the second light-emitting element is 80 nm or less.

2. The image forming method according to claim 1, wherein the second organic light-emitting element has a multilayer film mirror, a transparent electrode, at least one organic compound layer including a light-emitting layer, and a back-side electrode, in that order, on a transparent substrate; and an optical resonator structure is formed between the multilayer film mirror and the back-side electrode.

3. The image forming method according to claim 2, wherein for the second organic light-emitting element, the light-emission intensity at $\theta=30°$ is not more than 0.7 times the light-emission intensity at $\theta=0°$, assuming the direction perpendicular to the substrate (i.e., a light-emitting face) is $\theta=0°$, and the direction incident to 30° is $\theta=30°$.

4. The image forming method as claimed in claim 1, wherein the half width of the light-emission spectrum of the second light-emitting element is 60 nm or less.

5. The image-forming method as claimed in claim 1, wherein the color light-sensitive material is a silver halide color light-sensitive material.

6. The image-forming method as claimed in claim 5, wherein the silver halide color light-sensitive material is a diffusion transfer color light-sensitive material comprising:

a light-sensitive sheet, which comprises an image-receiving layer, a white reflecting layer, a light-shielding layer, and three light-sensitive silver halide emulsion layers that each are combined with a dye image-forming compound and each have a spectral sensitivity, at least, in the from first to third wavelength regions, provided on a transparent support, a transparent cover sheet, which has at least a neutralizing layer and a neutralization-timing layer provided on a transparent support, and a light-shielding alkaline composition positioned in a developable way between the light-sensitive sheet and the transparent cover sheet.

7. The image-forming method as claimed in claim 1, wherein the exposure time per pixel is 1 to $10^{-7}$ second.

8. An image forming method according to claim 1, wherein a plurality of each of the first to third organic light-emitting elements are provided to form a dot array.

* * * * *

UNITED STATES PATENT AND TRADEMARK OFFICE

CERTIFICATE OF CORRECTION

PATENT NO. : 6,355,393 B1
DATED : March 12, 2002
INVENTOR(S) : Hirai, Hiroyuki

It is certified that error appears in the above-identified patent and that said Letters Patent is hereby corrected as shown below:

Title page,
Item [30], under Foreign Application Priority Data insert

| | | | |
|---|---|---|---|
| -- | Mar. 10, 1999 | (JP) | 11-063483 |
| | Mar. 10, 1999 | (JP) | 11 063482 -- |

Signed and Sealed this

Sixteenth Day of July, 2002

*Attest:*

*Attesting Officer*

JAMES E. ROGAN
*Director of the United States Patent and Trademark Office*